United States Patent [19]

Worrall et al.

[11] Patent Number: 4,784,223

[45] Date of Patent: Nov. 15, 1988

[54] FORMING AN IMPERMEABLE COATING ON A BOREHOLE WALL

[75] Inventors: Robert N. Worrall; Robert B. Stewart, both of Rijswijk, Netherlands

[73] Assignee: Shell Oil Company, Houston, Tex.

[21] Appl. No.: 933,667

[22] Filed: Nov. 21, 1986

[30] Foreign Application Priority Data

Dec. 30, 1985 [GB] United Kingdom ..... 8531866

[51] Int. Cl.[4] ..... E21B 33/138

[52] U.S. Cl. ..... 166/287; 166/288; 166/293; 166/295; 175/72

[58] Field of Search ..... 166/285–287, 166/288, 292–295; 175/72; 523/130

[56] References Cited

U.S. PATENT DOCUMENTS

| | | | |
|---|---|---|---|
| 2,634,098 | 4/1953 | Armentrout | 175/72 |
| 2,776,111 | 1/1957 | Vance | 166/287 X |
| 2,836,555 | 5/1958 | Armentrout | 175/72 X |
| 3,022,824 | 2/1962 | Binkley et al. | 166/293 |
| 3,126,959 | 3/1964 | Ortloff | 166/287 |
| 3,208,521 | 9/1965 | Holland et al. | 166/286 |
| 3,209,823 | 10/1965 | Winkel | 166/286 X |
| 3,302,715 | 2/1967 | Smith et al. | 166/288 |
| 3,363,689 | 1/1986 | Smith et al. | 166/293 X |
| 3,461,960 | 8/1961 | Wilson | 166/286 X |
| 3,713,488 | 1/1973 | Ellenburg | 166/285 |
| 3,774,683 | 11/1973 | Smith et al. | 166/293 |
| 3,935,910 | 2/1976 | Gaudy et al. | 166/288 X |
| 4,378,050 | 3/1983 | Tatevosian et al. | 166/286 X |
| 4,650,520 | 3/1987 | Johnsen et al. | 166/293 X |

FOREIGN PATENT DOCUMENTS

| | | |
|---|---|---|
| 171703 | 7/1965 | U.S.S.R. . |
| 3804451 | 8/1932 | United Kingdom . |

OTHER PUBLICATIONS

Hampel et al., *Glossary of Chemical Terms,* Second Edition, 1982, pp. 231, copy in 3-4E16.

*Primary Examiner*—George A. Suchfield

[57] ABSTRACT

An impermeable and continuous coating is formed on the wall of a borehole in which a drill string is present by injecting coating forming components and a carrier fluid through the drill string. Subsequently the coating forming components are separated, e.g. in a decanting centrifuge, from the carrier fluid and plastered to the wellbore as a continuous layer.

34 Claims, 1 Drawing Sheet

FORMING AN IMPERMEABLE COATING ON A BOREHOLE WALL

BACKGROUND OF THE INVENTION

The invention relates to a method of forming an impermeable coating on the wall of a borehole penetrating subsurface earth formations.

During the course of well drilling operations, the wall of the borehole being drilled is generally sealed and stabilized by means of a protective steel casing which is lowered through the borehole and cemented in place after retrieval of the drilling assembly. Setting a steel casing in a well is a time consuming and expensive procedure and numerous attempts have been made to eliminate the need for such well casings. U.S. Pat. No. 3,774,683 discloses a method of stabilizing a borehole wall by means of a lining of cement reinforced with fibers. In accordance with this known stabilization process, a hydraulic cement plug is placed in the borehole and a core is drilled in the plug after the cement hardens. U.S. Pat. No. 3,302,715 discloses a method of solidification of a mud cake alongside a borehole wall by fusing sulphur particles contained therein. U.S. Pat. No. 3,126,959 discloses a method of forming a continuous plastic casing in a borehole by extruding plastic material alongside the borehole wall.

Although these known borehole stabilization systems provide useful alternatives to conventional steel casings, they still have the inherent disadvantage of application of equipment which is inserted in the well after retrieving the drilling assembly therefrom. However, pulling a drill string from a borehole is a time consuming and hazardous procedure. A major hazard resides in the fact that the upwardly moving drill string may create a considerable underpressure at the bottom of the hole. If the pressure inside the hole becomes lower than the formation pressure, ingress of formation fluids into the well may easily cause damage to the borehole wall and may occasionally lead to a well blowout.

SUMMARY OF THE INVENTION

The present invention aims to provide a safe and quick method of forming an impermeable coating on the wall of a borehole which can be carried out without retrieving the drill string from the hole.

The method according to the present invention comprises injecting a slurry containing coating forming components and a carrier fluid through the drill string, separating said components from the carrier fluid at a location close to the bottom of the borehole, packing said components against the borehole wall as a continuous layer, and allowing the layer of packed coating forming components to harden to an impermeable coating.

In a preferred embodiment of the invention, the coating forming components are separated from the carrier fluid in a decanter device, such as a strainer cyclone or centrifuge, which is arranged near the lower end of the drill string. It is furthermore preferred to inject the coating forming components, which may consist of hydraulic cement, fibrous reinforcing material and a polymeric resin, in pelletized form in a slurry which further comprises a low viscosity fluid e.g. a gas, oil, oil-water emulsion, clear water or brine.

BRIEF DESCRIPTION OF THE DRAWING

The invention will now be explained in more detail and by way of example with reference to the accompanying drawing, in which.

DESCRIPTION OF THE PREFERRED EMBODIMENT

Figure 1:
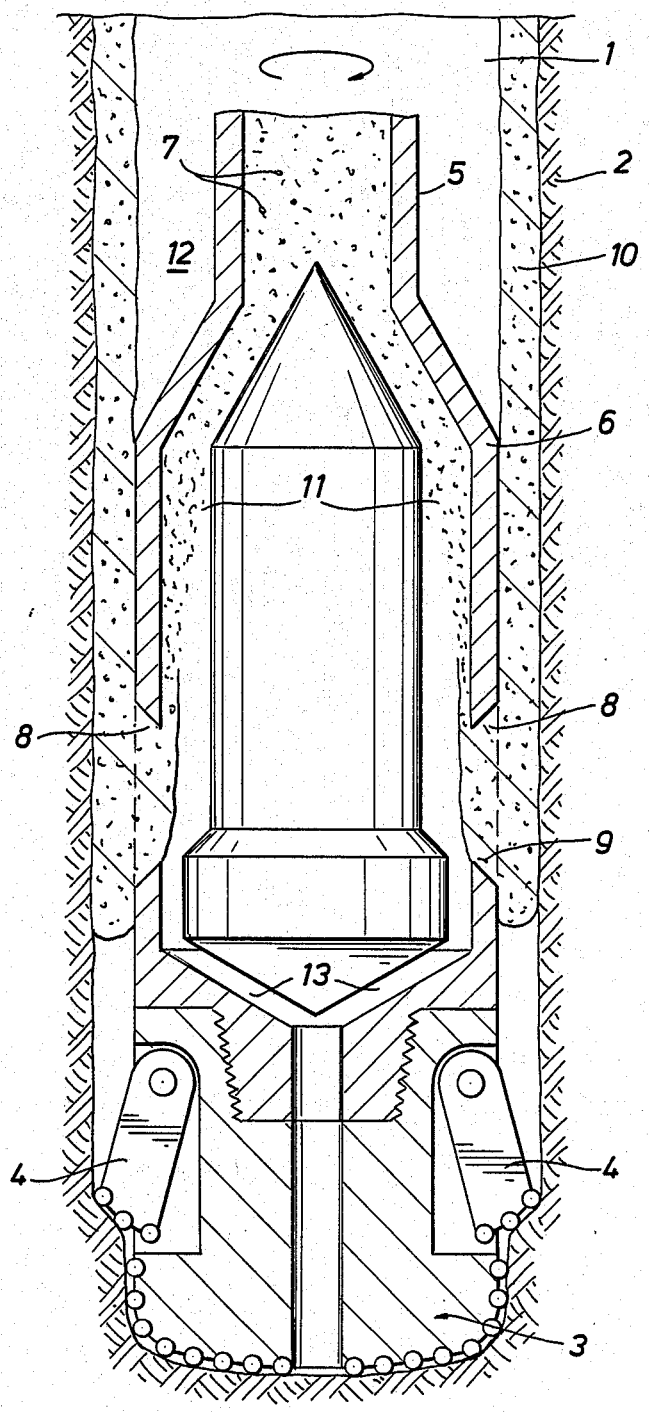
FIG. 1 is a cross-sectional view illustrating the bottom of a borehole in which an impermeable coating is formed using the method according to the invention.

In the drawing there is shown the bottom of a borehole 1 penetrating a subsurface earth formation 2. The hole 1 is being drilled by a rotary drill bit 3, which is provided with a pair of underreamers 4 and connected to the lower end of a drill string 5. The drill string 5 is at a location close to the bit 3 provided with a separator, here decanting centrifuge 6, which is intended to separate pellets 7 of coating forming components from a carrier fluid which is circulated down through the drill string 5 during drilling. In the example shown, the pellets 7 have a higher density than the carrier fluid so that the pellets 7 are packed against the inner wall of the centrifuge 6 by centrifugal force where they form a liquid mass 8 of coating forming components, which mass 8 is allowed to escape from the centrifuge 6 through orifices 9 and to form a continuous coating 10 on the borehole wall.

The centrifuge 6 looks externally like a stabilizer having a plurality of wings in which the separation chambers 11 are arranged. A straight or helical flow channel (not shown) is present between each pair of adjacent stabilizer wings via which the carrier fluid and drill cuttings may pass upwardly into the pipe/formation annulus 12. It is preferred to use as carrier fluid a low viscosity fluid such as gas, oil, oil-water emulsion, clear water or brine. The pellets 7 of coating forming components preferably consist of hydraulic cement mixed with fibrous reinforcing material e.g. steel, Kevlar®, carbon fibers and a thermosetting resin. The individual pellets may further be encapsulated in a protective skin which stops them gelling in the drill string or annulus or on surface, but which disintegrates with time or under downhole conditions of heat, pressure, centifugal force, magnetic field or radioactive radiation.

During operation of the assembly, the slurry of carrier fluid and pellets 7 is passed through the drill pipe 5 in turbulent flow so that the pellets cannot react together. The combined centrifugal forces and internal geometry of the separation chambers 11 then force the fluid mixture in laminar flow in the centrifuge 6.

The pellets 7 then are carried to the outer radial edge of the separation chambers 11 wherein they are transported along by the laminar flow and gravity. During or prior to this stage, the pellet's protective coating, if any, should become inactive.

The pellets 7 are then combined to a continuous mass 8 and are subsequently forced through the orifices 9 with a centrifugal force of several hundred or even thousand 'G' against the hole wall. There they set and form a continuous coating 10 on the wellbore, thus eliminating the need for a steel casing. Some pellets may be forced into the pores of the formation, thus greatly enhancing borehole stability, even if no or only a thin casing is cast. The geometry of the separation chambers 11 at the lower exit 13 is such that the carrier fluid is forced into turbulence. Excess cement protruding into the main flow is eroded away and redistributed in the carrier fluid. This is then circulated up the annulus 12 to surface where the excess cement is then removed by solids removal equipment such as shale shakers, hydrocyclones, decanting centrifuge, disk centrifuges, filters, etc.

In the example shown, the carrier fluid is passed through the bit 3 and alongside the underreamers 4 after leaving the centrifuge 6 and prior to being returned up the annulus 12, thereby cooling the bit and removing drill cuttings. It will be understood that the diameter of the bit body 3 is chosen slightly less than the outer diameter of the stabilizer/centrifuge wing like structures of centrifuge 6 to enable retrieval of the bit 3 through the coated wellbore. The thickness of the coating 10 is governed by the lateral distance at which the underreamers 4 protrude from the bit body 3.

A hydraulically or electrically driven downhole motor able to rotate the centrifuge at about 800–1000 revolutions per minute may be mounted in the drill string above the centrifuge 6 to allow the centrifuge 6 to obtain a high rotational speed while forming the coating.

The coating 10 may be formed while drilling takes place simultaneously. It may, however, be preferred to drill borehole sections of say 27 m without forming the coating, to subsquently raise the drill string 27 m such that the orifices are located at the top of the section or interval where a coating is to be formed, then to subsequently lower the string gradually through said interval while rotating the centrifuge at high speed and circulating pellets down through the drill string, until the bit reaches the bottom of the hole. The next hole section is drilled and subsequently plastered using a similar procedure.

Alternatively, the coating could be applied after a section of hole has been drilled and the drill string is being withdrawn from the drilled section, e.g. to change the bit.

The design of the decanting centrifuge should be modified if the pellets of coating forming components are lighter than the carrier fluid such that the pellets, which then concentrate in the center of the centrifuge, are led by radial flow conduits to the outside of the stabilizer wings.

If desired, alternative decanting devices may be used to separate the pellets from the carrier fluid. For example, a strainer, grill or a device which is able to generate magnetic or electrostatic field may be installed in the drill string. Additionally, a device may be mounted in the drill string which enhances the speed of coagulating the coating forming components once they are plastered to the wellbore. Suitable coagulating enhancing devices are sources which generate heat, or a strong magnetic field or radioactive radiation. Since such devices are known per se, no detailed description of their operation is required.

Any suitable coating forming material may be used to plaster the wellbore. Injection of pellets containing hydraulic cement, fibers and a polymeric resin has the advantage that a strong coating can be formed having a strength equivalent to a steel casing, but which can be formed without raising the drill string from the borehole or even while drilling takes place simultaneously. In stable, but permeable, formations it may be desired to plaster the wellbore with a coating which seals off the wellbore without necessarily increasing the wall stability. In such formations the coating may be formed by a plastic material only, such as thermosetting epoxy resin.

The pellets of coating forming components may further be injected in slugs which are alternated by slugs of drilling fluid or separate from the drilling fluid through a separate conduit which extends along at least part of the length of the drill string. The pellets may have any suitable shape and size. The size of the pellets is preferably selected between 1μ and a few centimeters.

It will further be understood that, instead of using a bit provided with one or several underreamers to drill the oversized hole, an eccentric bit or a bit provided with jet recuming means may be used as well.

Many other variations and modifications may be made in the apparatus and techniques described above without departing from the concept of the present invention. Accordingly, it should be clearly understood that the apparatus and methods depicted in the accompanying drawings and referred to in the foregoing description are illustrative only and not intended as limitations on the scope of the invention.

What is claimed is:

1. A method of forming an impermeable coating on the wall of a borehole in which a drill string is present, the method comprising:

injecting a slurry containing coating forming components in a pelletized form and a low viscosity carrier fluid through the drill string;

separating said components from the carrier fluid at a location close to the bottom of the borehole;

packing said separated components against the borehole wall as a continuous layer; and allowing the layer of packed coating forming components to harden to an impermeable coating.

2. The method of claim 1, wherein the pelletized coating forming components are separated from the carrier fluid in a decanting device which is arranged near the lower end of the drill string.

3. The method of claim 2, wherein the decanting device is a centrifuge.

4. The method of claim 2, wherein the decanting device is a strainer.

5. The method of claim 1, wherein during transport thereof through the drill string the individual pellets are each encapsulated in a protective skin which is allowed to disintegrate after separating the pellets from the slurry.

6. The method of claim 1, wherein the coating forming components comprise a hydraulic cement, fibrous reinforcing material and a polymeric resin.

7. The method of claim 1, wherein the coating forming components comprise a thermosetting epoxy resin.

8. The method of claim 1, wherein the drill string is further provided with a device for enhancing coagulating said coating forming components.

9. The method of claim 8, wherein said coagulating enhancing device consists of a heat source.

10. A method of forming an impermeable coating on the wall of a borehole in which a drill string is present, the method comprising:

preparing a slurry from coating forming components in pelletized form and a low viscosity carrier fluid;

injecting the slurry through the drill string;

separating said components from the carrier fluid at a separator in the drill string;

packing said separated components against the borehole wall as a continuous layer; and allowing the layer of packed coating forming components to harden to an impermeable coating.

11. The method of claim 10, wherein injecting the slurry comprises directing the slurry through the drill string to the separator at a location close to the borehole bottom.

12. The method of claim 10, wherein separating said coating forming components includes decanting the slurry.

13. The method of claim 12, wherein decanting the slurry comprises centrifuging the slurry.

14. The method of claim 12, wherein decanting the slurry comprises straining the slurry.

15. The method of claim 10, wherein injecting the slurry includes transporting the components through the drill string in which the individual pellets of the coating forming components are each encapsulated in a protective skin, and further comprising:

disintegrating the protective skin from the pellets after separating the pellets from the carrier fluid.

16. The method of claim 10, further comprising preparing the slurry from a hydraulic cement, fibrous reinforcing material and a polymeric resin in a carrier fluid.

17. The method of claim 10, further comprising preparing a slurry of a thermosetting epoxy resin in a carrier fluid.

18. The method of claim 10, further comprising enhancing the coagulation of said coating forming components.

19. The method of claim 18, wherein enhancing the coagulation of the coating forming components comprises applying a heat source to the packed components.

20. A method of forming an impermeable coating on the wall of a borehole in which a drill string is present, the method comprising:

preparing a slurry from coating forming components in pelletized form and a low viscosity carrier fluid;
injecting the slurry through the drill string;
separating said components from the carrier fluid at a separator in the drill string;
packing said components against the borehole wall as a continuous layer; and
allowing the layer of packed coating forming components to harden to an impermeable coating.

21. The method of claim 20 wherein injecting the slurry comprises directing the slurry through the drill string to the separator at a location close to the borehole bottom.

22. The method of claim 20 wherein injecting the slurry includes transporting the components through the drill string in which the individual pellets of the coating forming components are each encapsulated in a protective skin, and further comprising:

disintegrating the protective skin from the pellets after separating the pellets from the carrier fluid.

23. A method of forming an impermeable coating on the wall of a borehole in which a drill string is present, the method comprising:

preparing a slurry from coating forming components including a hydraulic cement, fibrous reinforcing material and a polymeric resin in a carrier fluid;
injecting the slurry through the drill string;
separating said components from the carrier fluid at a separator in the drill string;
packing said components against the borehole wall as a continuous layer; and
allowing the layer of packed coating forming components to harden to an impermeable coating.

24. The method of claim 23, wherein injecting the slurry comprises directing the slurry through the drill string to the separator at a location close to the borehole bottom.

25. A method of forming an impermeable coating on the wall of a borehole in which a drill string is present, the method comprising:

preparing a slurry of coating-forming components including a thermosetting epoxy resin and a carrier fluid;
injecting the slurry through the drill string;
separating said components from the carrier fluid at a separator in the drill string;
packing said components against the borehole wall as a continuous layer; and
allowing the layer of packed coating-forming components to harden to an impermeable coating.

26. The method of claim 25 wherein injecting the slurry comprises directing the slurry through the drill string to the separator at a location close to the borehole bottom.

27. A method of forming an impermeable coating of the wall of a borehole in which a drill string is present, the method comprising:

injecting a slurry comprising coating-forming components and a carrier fluid through the drill string;
separating said components from the carrier fluid at a separator in the drill string;
packing said components against the borehole wall as a continuous layer;
allowing the layer of packed coating-forming components to harden to an impermeable coating; and
enhancing the coagulation of the coating-forming components by applying a heat source to the packed components.

28. The method of claim 27, wherein injecting the slurry comprises directing the slurry through the drill string to the separator at a location close to the borehole bottom.

29. A method of forming an impermeable coating on the wall of a borehole in which a drill string is present, the method comprising:

injecting a slurry containing coating forming components and a carrier fluid through the drill string, wherein said coating forming components comprise a hydraulic cement, fibrous reinforcing material and a polymeric resin;
separating components from the carrier fluid at a location close to the bottom of the borehole;
packing said separated components against the borehole wall as a continuous layer; and
allowing the layer of packed coating forming components to harden to an impermeable coating.

30. A method of forming an impermeable coating on the wall of a borehole in which a drill string is present, the method comprising:

injecting a slurry through the drill string which contains a carrier fluid and coating forming components comprising a thermosetting epoxy resin;
separating said components from the carrier fluid of a location close to the bottom of the borehole;
packing said separated components against the borehole wall as a continuous layer; and
allowing the layer of packed coating forming components to harden to an impermeable coating.

31. A method of forming an impermeable coating on the wall of a borehole in which a drill string is present, the method comprising:

preparing a slurry from a low viscosity carrier fluid and coating forming components comprising a hydraulic cement, fibrous reinforcing material and a polymeric resin;

injecting the slurry through the drill string;

separating said components from the carrier fluid at a separator in the drill string;

packing said components against the borehole wall as a continuous layer; and allowing the layer of packed coating forming components to harden to an impermeable coating.

32. A method of forming an impermeable coating on the wall of a borehole in which a drill string is present, the method comprising:

preparing a slurry from a low viscosity carrier fluid and coating forming component comprising a thermosetting epoxy resin;

injecting the slurry through the drill string;

separating said components from the carrier fluid at a separator in the drill string;

packing said components against the borehole wall as a continuous layer; and allowing the layer of packed coating forming components to harden to an impermeable coating.

33. The method of claim 32, further comprising enhancing the coagulation of said coating forming components.

34. The method of claim 33, wherein enhancing the coagulation of the coating forming components comprises applying a heat source to the packed components.

* * * * *